United States Patent [19]

Nelson et al.

[11] Patent Number: 5,014,943

[45] Date of Patent: May 14, 1991

[54] TRASH BAG HOLDER

[76] Inventors: Dean O. Nelson; Richard W. Nelson, both of 1775 Hacienda Ave., Campbell, Calif. 95008

[21] Appl. No.: 544,986

[22] Filed: Jun. 28, 1990

[51] Int. Cl.[5] ..... B65B 67/04

[52] U.S. Cl. ..... 248/99; 15/257.1; 294/55

[58] Field of Search ..... 248/150, 152, 95, 97, 248/99, 100, 101; 15/257.1; 383/33; 150/49; 294/55; 53/390; 141/90

[56] References Cited

U.S. PATENT DOCUMENTS

| | | | |
|---|---|---|---|
| 3,697,030 | 10/1972 | Schultz | 15/257.1 X |
| 3,942,832 | 3/1976 | Haas | 248/101 |
| 3,998,415 | 12/1976 | D'Antonio | 15/257.1 X |
| 4,695,020 | 9/1987 | Collins | 248/95 X |
| 4,750,695 | 6/1988 | Greenhouse | 248/99 |
| 4,759,519 | 7/1988 | Cheng | 248/99 |
| 4,832,291 | 5/1989 | Nelson | 248/99 |
| 4,881,706 | 11/1989 | Sedlik | 248/150 X |

*Primary Examiner*—J. Franklin Foss
*Attorney, Agent, or Firm*—John J. Leavitt

[57] ABSTRACT

A hoop, in collapsed configuration fitting readily into the mouth of a plastic trash bag, is formed from a synthetic resionous material and is peripherally expandable from its collapsed form to fit tightly against the inner surface of the bag and hold the bag securely in place with the mouth open. The hoop has provision for either free-standing use with the bag mouth in the vertical position, when trash may be swept directly into the opening, or mounting on a vertical support with the bag mouth in the horizontal position for use as a trash receptacle. A pan attached by a flexible integral connection to the hoop serves both as a threshold when sweeping trash into the bag, and as a lid when the bag is used as a trash receptacle. The flexible integral interconnection of the hoop and pan also permits compact storage and transportation of the holder in assembled form, and even greater space savings when stored or shipped in "blank" form as one flat integral unit.

5 Claims, 3 Drawing Sheets

TRASH BAG HOLDER

BACKGROUND OF THE INVENTION

1. Field of the Invention

This invention relates to devices for holding limp bags, such as limp plastic trash bags, in an open position for filling, and in particular to such a device that is molded integrally from synthetic resinous material as a unitary "blank" for conformation into a holder that facilitates the filling of trash bags used for disposing of garden, industrial and commercial waste materials.

2. Description of the Prior Art

This invention is related to U.S. Pat. No. 4,832,291 issued May 23, 1989 from application Ser. No. 74,263 filed July 16, 1987 by the inventors herein, and constitutes an improvement thereof in that the trash bag holder has now been designed for fabrication utilizing synthetic resinous material forming techniques to reduce the cost of manufacture and to thus enable passing on to the ultimate consumer the savings that result therefrom.

The prior art related to this invention is believed to reside in Class 248, sub-classes 95, 97, 99, 100, and in the field of search indicated in the above noted U.S. Pat. No. 4,832,291, included herein by reference. The patents cited in U.S. Pat. No. 4,832,291 are included herein by reference. Additionally, applicant notes the existence of U.S. Pat. Nos. 4,659,045; 3,754,785 and 4,052,764, the first of which was discussed in U.S. Pat. No. 4,832,291 issued to the inventors of the instant invention. As will be apparent from a careful perusal of the prior art noted above, there are superficial similarities in the prior art to the instant invention, but there are also several distinguishing features and important innovations in the present invention which are absent from the prior art, including the inventors' prior U.S. Pat. No. 4,832,291.

One of the objects of the present invention is to provide a device which can spread the open end of a plastic bag so as to produce a large and unobstructed opening, and to maintain the opening in this condition during use.

A further object of the invention is to be able to expand the bag opening from inside the mouth of the bag with a hoop having a variable peripheral dimension, so that the hoop may be readily introduced into the mouth of the bag, but may then be expanded to produce a tight fit against the inner surface of the bag, thereby preventing the bag from slipping off the hoop.

As it is intended that this device shall be capable of use in a wide variety of trash collecting situations it is an additional object of the invention that a stable opening and connection to the bag be provided for all possible orientations of the opening. Thus, provision is made for the opening to be verical and free-standing on the ground when used for collecting leaves and other garden trash, and also to be mountable above ground on a fixed or movable support with the opening in a horizontal position for more general waste collection, such as discarded metallic soft drink cans and plastic bottles, collected for recycling purposes.

Providing a means to facilitate the movement of trash into the bag is a further object of the invention. This is accomplished by the provision of a specially designed pan attached by a "live" hinge to the hoop. The pan acts as a threshold or entrance ramp for easing the task of, for example, sweeping or raking leaves through the opening of the bag. The pan serves a similar role by acting as a backplate when the opening of the bag is horizontal, and as a lid when folded down over the horizontally oriented opening.

For storage and transportation purposes associated with both use and commercial sale and distribution, a compact design is important. To this end, an additional objective of the invention is realized by the ability to fold the pan over the hoop to thus achieve a compact configuration.

A still further object of the invention is the provision of a trash bag holder that is fabricated from synthetic resinous material so as to be impervious to moisture and rust, and which may be molded in a single "blank" simple to conform into its finished conformation to thus minimize the cost of assembly of the trash bag holder.

The invention possesses other objects and features of advantage, some of which, with the foregoing, will be apparent from the following description and the drawings. It is to be understood however that the invention is not limited to the embodiment illustrated and described, since it may be embodied in various forms within the scope of the appended claims.

SUMMARY OF THE INVENTION

The present invention provides a device for holding the entrance of a limp bag or sack in an open position and at suitable orientations for ease of filling. Provision is also made for facilitating the filling process.

This is accomplished by inserting a resilient flexible hoop incorporating a "live" hinge enabling initial collapse of the hoop to a minimum peripheral dimension into the mouth or open end of a plastic or other suitable bag and then expanding the hoop within the bag in order to hold the entrance of the bag in an open position. A means for expanding the peripheral dimension of the hoop is provided such that the hoop tightens against the inner wall of the bag and holds the bag firmly in position.

The further orientation of the open entrance of the bag is now at the convenience of the user since the opening may be readily placed or fixed in either a vertical or horizontal position, means for both of which are provided by the invention.

Filling the bag when the open entrance is in either a vertical or horizontal position is assisted by a facilitating means, for moving materials toward the open bag entrance, in the form of a flexibly attached integral pan, threshold, ramp or backplate. This integral pan further serves as a lid when the device is used with the bag entrance in the horizontal position, as when the device is mounted on a hand-truck or on a wall.

DESCRIPTION OF THE PREFERRED EMBODIMENT

Figure 1:
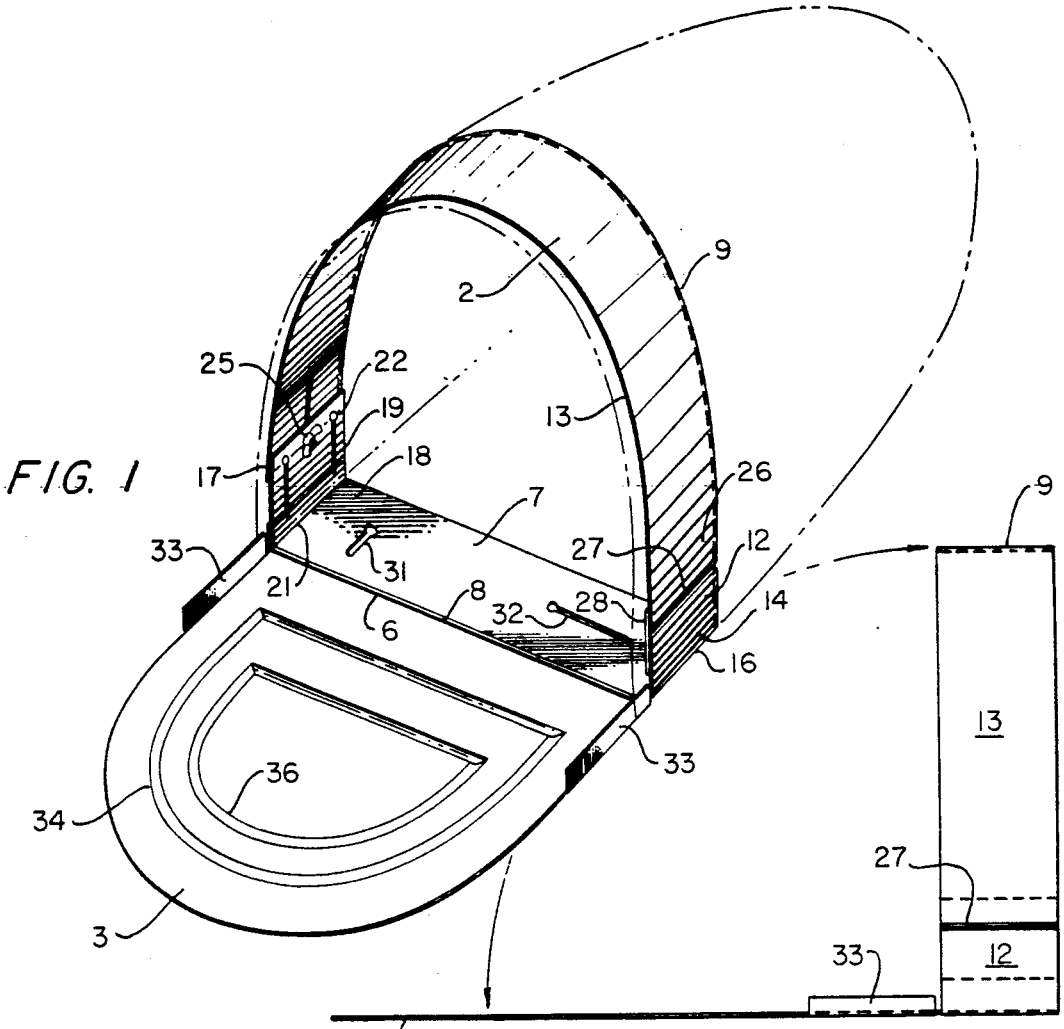
FIG. 1 is a perspective view of the holder in expanded mode with a trash bag secured in place and the pan in the threshold position for horizontal filling of the trash bag.
Figure 2:
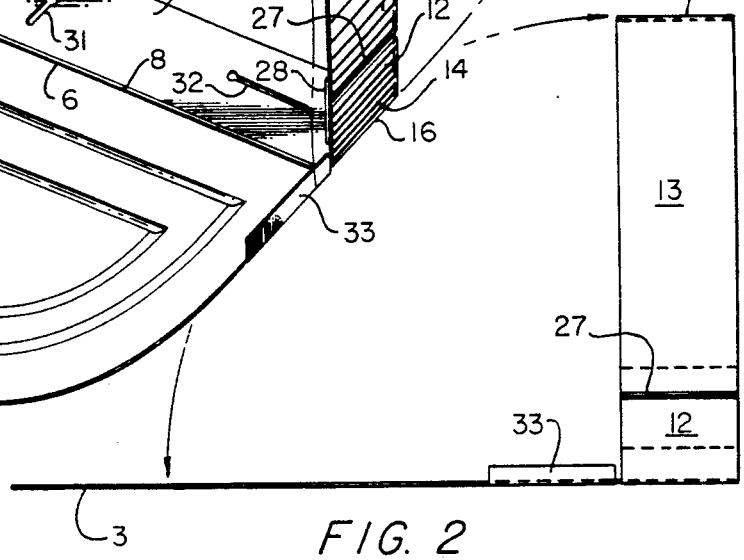
FIG. 2 is a side elevation of the holder in expanded mode with the pan in the threshold position.

An embodiment of the invention which is particularly effective is illustrated in the accompanying drawings and has two major components, both formed from synthetic resinous material, hereinafter referred to as "plastic" material: a hoop 2 and a pan portion 3, these two components being integrally connected by a long flexible "hinge" 6 formed from the same material from which the hoop and pan are formed, but thinner in cross-section so as to provide the desired flexibility in the union to permit pivoting of the pan in relation to the hoop through about 90° from an extended position perpendicular to the plane containing the hoop to a collapsed position parallel to the plane containing the hoop. As seen in the drawings, the integral and flexible "hinge" 6 connects the flat member 7 of the hoop with the edge portion 8 of the pan.

The curved member 9 of the hoop contains two integral short and long segments 12 and 13, respectively, of equal width. One end 14 of the short segment 12 is connected through a first integral "live" hinge 16 to the associated end portion of the flat member 7 so that the inner surface of the short segment and the associated surface of flat member 7 may come into contact with each other, or present a variable angle to each other through flexure of the "live" hinge. One end 17 of the long segment 13 is adjustably and detachably secured perpendicularly to the remaining end 18 of the flat member 7 through the interposition of a perpendicular segment 19 of equal width with the flat member 7 and the hoop member 13, which is attached to the flat member 7 either through a flexible and integral "live" hinge 21 that enables the segment 19 to be injection molded in a flat plane with the flat member 7 and subsequently flexed into a perpendicular orientation, or which is integral with the flat member 7 in a non-flexible right angle orientation. The right angle extension 19 is adjustably connected to the associated end portion 17 of the member 9 by appropriate bolts or rivets 22 the shanks of which pass through appropriate bores 23 in the end portion 17 and associated slots 24 formed in the extension 19. A wing nut 25 may be tightened to clamp the two juxtaposed members 17 and 19 in adjusted position, or loosened to enable readjustment of the juxtaposed members 17 and 19 to enable the application of different size trash bags on the hoop. It will thus be seen that the purpose of the adjustable connection between the members 17 and 19 is to enable a variation of the ultimate peripheral dimension of the hoop formed by the members 7 and 9 to accommodate plastic trash bags of different diameters, such as 28, 30 and 33 gallon capacity trash bags.

Figure 3:
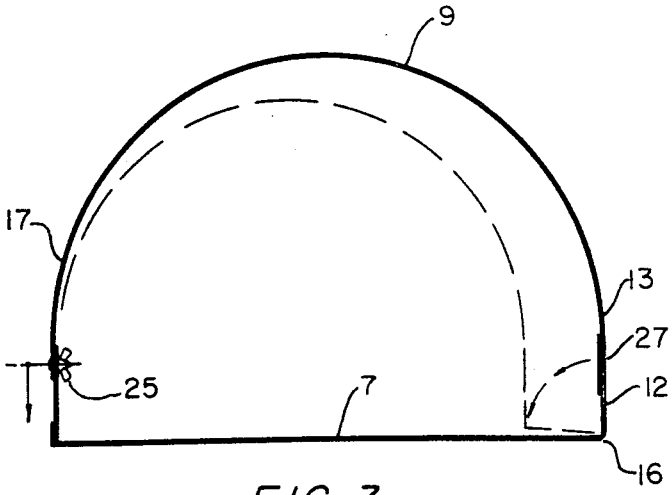
FIG. 3 is a front view showing the holder in expanded D-shaped (solid lines) and collapsed P-shaped (broken lines) modes.
Figure 4:
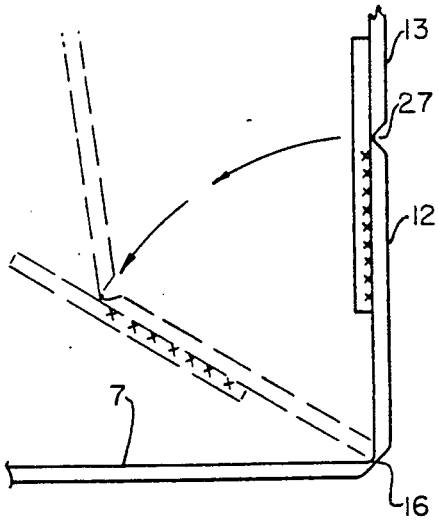
FIG. 4 is an enlarged and partially cross-sectional view of the flexible integral connection which permits transformation between the expanded and collapsed modes.
Figure 6:
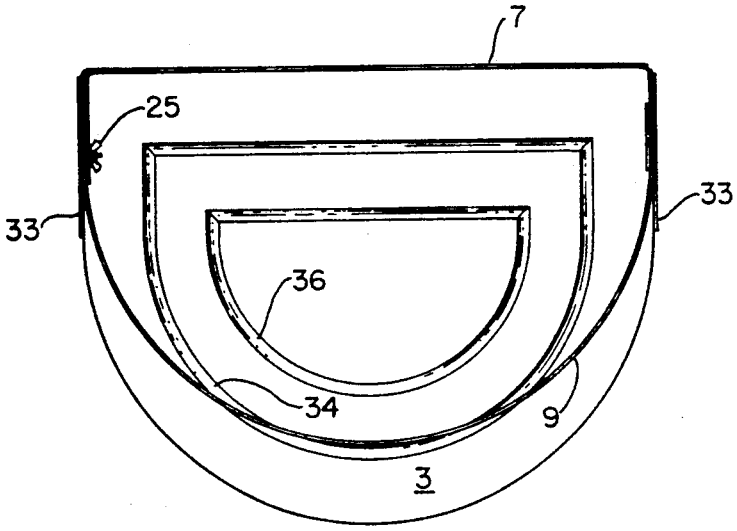
FIG. 6 is a plan view of the device folded for storage or shipping in the closed position.
Figure 7:
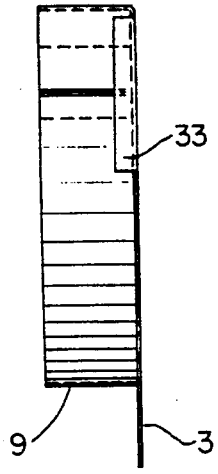
FIG. 7 is a side view of the device folded for storage or shipping in the closed position.
Figure 8:
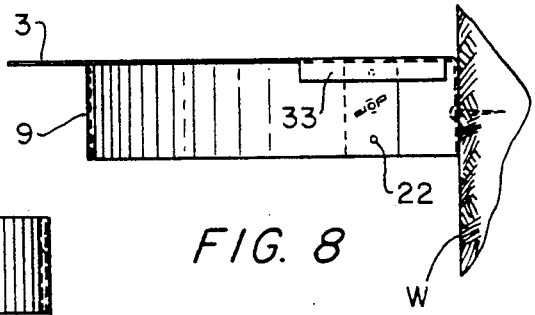
FIG. 8 is a side view of the device mounted on a wall in the closed position.
Figure 5:
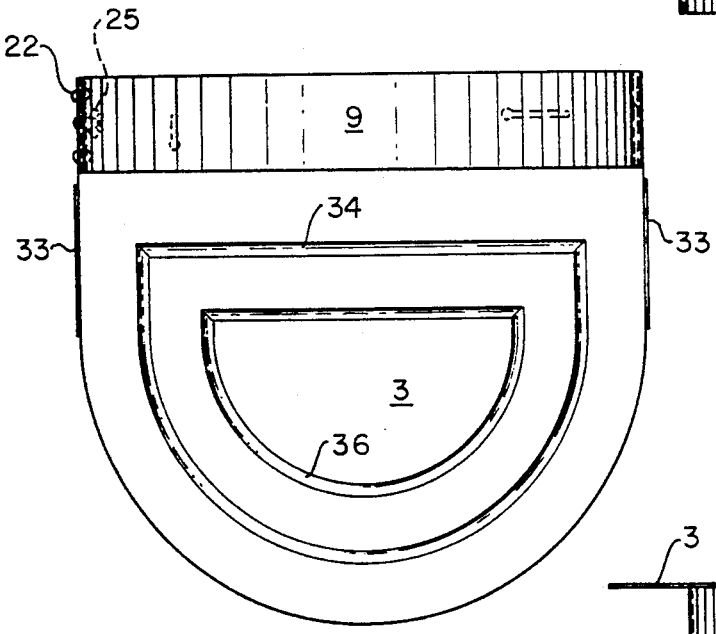
FIG. 5 is a plan view of the holder in expanded mode with the pan in the threshold position.
Figure 9:
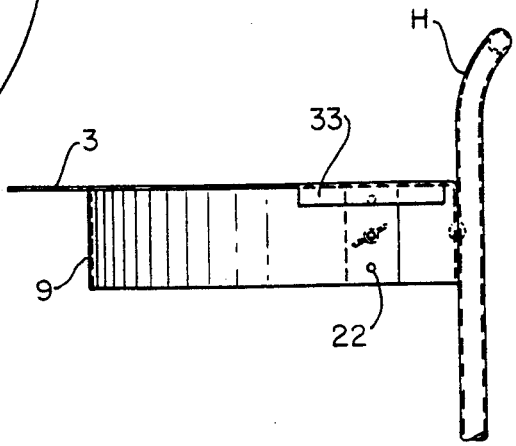
FIG. 9 is a side view of the device in closed form mounted on a frame member of a hand-truck.

The other end 26 of the long segment 13 associated with the short segment 12 is flexibly and integrally connected by a "live" hinge 27 to the short segment 12 along a line intermediate the ends of the short segment 12. The short segment 12 is provided with an integral offset portion 28 that extends past the hinge 27 to lie contiguous to the inner surface of the end portion 26 of the long member 13 when the hoop is in an extended D-shaped configuration as shown in FIG. 1, but which separates from the inner surface of the end portion 26 when the "live" hinge 27 is flexed to conform the hoop 9 and flat member 7 into a P-shaped configuration as shown in FIG. 3. When the device is in its extended position, as when it is inserted into the mouth of a plastic trash bag and expanded, the offset portion 28, abutting the associated surface of the end portion 26, functions as a stop to prevent overextension of the hinge, restricting outward movement of the two segments to the form of a smooth curve.

The first and second hinges connecting the short segment 12 to the flat member 7 and the long segment 13, respectively, provide the possibility for two configurations or modes for the hoop 2: an expanded or D-shaped mode as seen in FIG. 1, and a collapsed or P-shaped mode as illustrated in FIG. 3. In the D-shaped mode the long and short segments form a smooth curve representing an equilibrium between the tendency of the resilient segments to straighten, and the restiction placed upon this tendency by the stop formed by the overlapping of the segments at the second hinge 27. The P-shaped mode is assumed when the second hinge 27 is pressed inwardly, forcing the short segment to rotate about the first hinge and lie parallel to and in contact with the flat member 7, and positioning the long segment to form an approximate right angle with the short segment at the second hinge 27. This increases the flexing of the long segment, which now accounts for the entire curved portion of the hoop. It will be readily appreciated that the peripheral dimension of the hoop in the collapsed or P-shaped mode is less than that in the expanded or D-shaped mode and this fact together with the ease with which the two modes may be alternated are important novel features of the present invention, because they permit the ready and rapid mounting of a bag on the hoop.

The flat member 7, in addition to serving as a site of attachment of the rectangular pan 3, provides a flat base upon which the hoop may rest in an upright freestanding position. The flat member is also supplied with key-hole slots 31 and 32, one oriented transverse to the flat member 7, while the other is oriented longitudinally of the flat member so as to provide a measure of acceptance of fastening devices that are variably spaced. The key-hole slots serve to mount the hoop on a wall W or hand-cart H by means of suitable supports such as screws or hooks, for example.

The integral pan is provided with upwardly-directed perpendicular flanges 33 along the two side edges and stiffening ribs 34 and 36 molded into the pan in the patterns shown. It will of course be apparent that other stiffening rib patterns may be adopted without departing from the spirit of the invention. The flanged side edges help to direct the flow, and prevent materials from spilling sideways off the pan, while the ribs prevent the pan from flexing out of its flat configuration.

Figure 10:
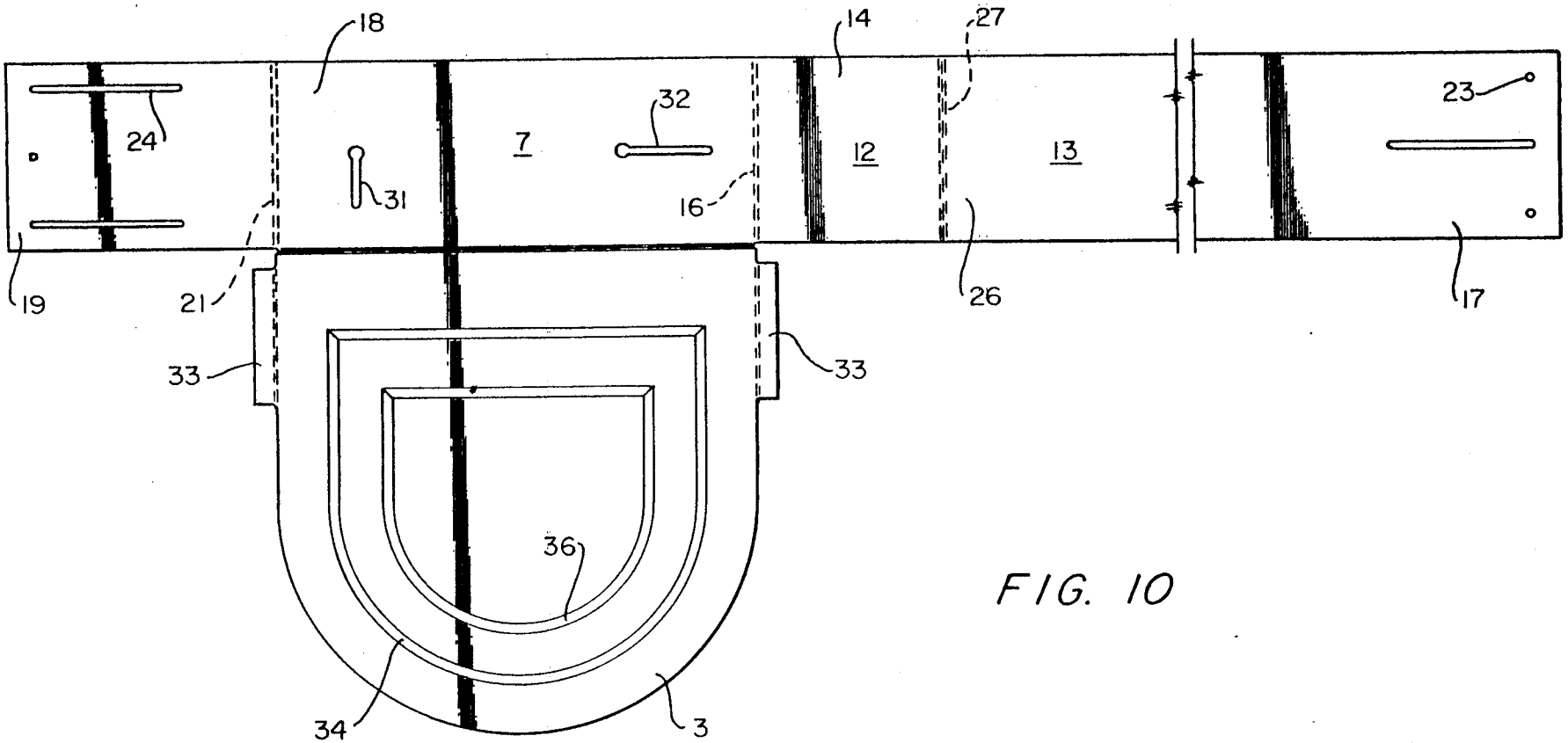
FIG. 10 is a plan view of the holder "blank" formed from synthetic resinous material and shown prior to conformation into a completed holder device.

When the device is mounted on a wall or hand-cart the pan may serve either as a lid with the side flanges directed downwardly outside the hoop, or oriented vertically as a backplate, when the pan again serves to direct materials through the hoop. Folding the pan over the hoop also provides a convenient and compact size and shape for shipping and storage of the device in assembled form. For greater economy in shipping large numbers of the device, it will of course be apparent that upon removal of the bolts 22 and the wing nut 25, the entire assembly may be laid flat in extended unitary form as viewed in FIG. 10, thereby enabling multiple numbers of the device "blanks" to be stacked flat one upon another and shipped in a single container for assembly at the point of purchase or by the purchaser.

For mounting a trash bag on the hoop a variety of techniques may be employed. However, in the most favoured method, which is particularly valuable when the holder is to be used in a free-standing situation, as in a garden, the device is placed with the hoop in an upright position and the flat member of the hoop on the ground. The pan is also permitted to rest flat upon the ground. The operator stands with one foot on the pan to steady the device and exerts slight downward and inward hand pressure on the hoop at a point somewhat above the hinged section of the hoop. This collapses the hoop into the P-shaped configuration where it may be readily held with one hand. By slightly tilting the hoop towards the pan with the same hand the underside of the flat member is raised off the ground and the opening of a suitably-sized plastic or similar bag is introduced under the rear edge of the flat member with the other hand. The hoop is then tilted upright again and the remainder of the edge of the opening of the bag draped over and around the curved portion of the hoop. For the most satisfactory results it is best if the edge of the bag extends somewhat beyond the edge of the front, or pan side, of the hoop at all points. The hoop is then allowed to return to the D-shaped configuration in which, because of its now increased perpheral dimension, it tightens against the inner surface of the bag, holding the bag secure and with an open mouth ready for filling.

The invention may be made of any material or combination of materials which provide sufficient strength, structural integrity and rigidity or flexibility as occasion demands. In the embodiment of the invention illustrated and described herein, polymeric plastic materials that are capable of injection molding to provide the thin cross-section of the flat members of the device, and which may be formed with integral "live" hinge lines are preferred.

Although the invention has been described above by reference to a preferred embodiment in which the pan 3 is integrally and flexibly attached through a "live" hinge to the hoop 2, it should be noted that the hoop has utility in its own right, even in the absence of the pan. It will be appreciated that this, and other constructions and configurations that may be devised, are, nevertheless, within the scope and spirit of the invention and are defined in the appended claims.

We claim:

1. A trash bag holder formable from a flat blank of synthetic resinous material, which when formed, comprises:

(a) a hoop for retaining the mount of a trash bag in open position when the hoop is inserted thereinto, said hoop including:

(b) a flat rectangular rigid member defined by two long edges and two short edges and having an inner surface and an outer surface;

(c) a short rectangular inherently resilient segment having an inner surface and an outer surface, said short segment having first and second short edges, said first short edge integrally attached by a first flexible connection along a first short edge of said flat member, whereby the inner surface of said short segment may be brought into contact with the inner surface of said flat member by rotation of said short segment about said integral flexible connection, said second short edge of said short segment being unattached; and (d) a long curved rectangular inherently resilient segment having an inner surface and an outer surface, said long segment having a first short edge adjustably interconnected to said flat member adjacent the end thereof remote from said first short edge thereof such that the surfaces of the flat member and long curved segment are perpendicular to each other at their interconnection and selectively slidable in relation to each other to vary the size of the hoop to fit different size trash bags, said long curved segment having a second short edge attached by a second integrally flexible connection to an intermediate portion of said short segment, said second integrally flexible connection being parallel to and spaced between the first integrally flexible connection of said short segment and said unattached second short edge of said short segment, whereby the outer surface of said short segment between the second hinged connection and the unattached second short edge of said short segment may press against the inner surface of said long segment thereby to provide a stop limiting outward movement of the second integral flexible connection to maintain a smooth curvature of the attached short and long segments between their respective attachments to said flat member, whereby a hoop structure is formed capable of being selectively transformed between:

(i) a contracted P-shaped mode wherein, by rotation about the first flexibly integral connection, said short segment lies in contact with said flat member and said short and long segments form a right angle at the second flexibly integral connection, thereby facilitating the placement of the opening of a trash bag around the outer surfaces of the flat member and short and long segments, and (ii) an expanded D-shaped mode in which the flat member and short and long segments form an expanded periphery on which the trash bag is stretched and held firmly in place.

2. A trash bag holder according to claim 1, further including an integral pan forming a portion of said flat blank and having upper and lower surfaces and a rear edge in flexibly integral connection to a long edge of said flat member such that the upper surface of said pan may be rotatably positioned in contact with the edge of said hoop, whereby, depending upon the particular orientation chosen, the pan may serve both as an entrance ramp for introducing trash into, and as a lid over, the D-shaped opening of the trash bag holder.

3. The trash bag holder according to claim 1, in which means are interposed between said flat rectangular member and the associated end portion of said elongated flexibly resilient member selectively manipulable to enlarge or decrease the peripheral dimension of the hoop formed thereby.

4. The trash bag holder according to claim 2, in which said pan has two upwardly perpendicular flanged side edges.

5. The trash bag holder according to claim 2, in which said pan is provided with a downwardly and an upwardly directed rib pattern extending from the upper and lower surfaces thereof to lend rigidity to the pan.

* * * * *